United States Patent [19]

Tanaka et al.

[11] 4,257,435

[45] Mar. 24, 1981

[54] MISCHIEF PREVENTING DEVICE FOR A COIN SORTING MACHINE

[75] Inventors: Akio Tanaka; Yoshihisa Nakajima; Shinji Yokomori, all of Kawasaki, Japan

[73] Assignee: Fuji Electric Co., Ltd., Kawasaki, Japan

[21] Appl. No.: 913,165

[22] Filed: Jun. 6, 1978

[30] Foreign Application Priority Data

Jun. 7, 1977 [JP] Japan ..... 52-66973

[51] Int. Cl.[3] ..... G07D 3/16; G07F 3/02

[52] U.S. Cl. ..... 133/3 R; 194/97 R; 194/100 A

[58] Field of Search ..... 194/97 R, 100 R, 100 A, 194/99, 101, 102, 1 K; 73/163; 133/3 R, 3 H, 8 A

[56] References Cited

U.S. PATENT DOCUMENTS

| | | | |
|---|---|---|---|
| 3,916,922 | 11/1975 | Prümm | 133/3 R |
| 3,998,309 | 12/1976 | Mandas et al. | 194/97 R |
| 4,106,610 | 8/1978 | Heiman | 194/97 R |

*Primary Examiner*—F. J. Bartuska

*Attorney, Agent, or Firm*—Sughrue, Rothwell, Mion, Zinn and Macpeak

[57] ABSTRACT

Erroneous counting of both false coins and real coins tied to a string is prevented by providing a two stage counter with a gate in the middle. The first stage determines whether the coin is real and, if real, what its value is. If the coin is real a gate is opened and the coin passes a detector which shuts the gate while simultaneously counting the coin value from the first stage.

2 Claims, 3 Drawing Figures

MISCHIEF PREVENTING DEVICE FOR A COIN SORTING MACHINE

BACKGROUND OF THE INVENTION

This invention relates to a coin sorting machine in which a sorting coil is arranged along a coin passage, and the characteristics of coins are determined by a sorting means employing the sorting coil, to thereby sort out coins inserted thereinto. More particularly, the invention is related to a device for preventing an erroneous coin counting operation which may be caused by a real coin inserted thereinto with a string attached.

For instance, in a coin sorting device for an automatic vending machine, a sorting coil is provided along a coin passageway, and the characteristics of coins are determined by a sorting means employing the sorting coil. There are typically three different sorting means. In a first sorting means, a bridge circuit is made up of a sorting coil and a reference impedance coil and the balance of the bridge circuit occurring when a coin passes through the sorting coil is detected. In a second sorting means, an oscillation coil and a reception coil are provided to serve as sorting coil, and the variation of the voltage induced in the reception coil when a coin passes through the oscillation coil is detected. In a third sorting means, an oscillator having a sorting coil as its resonance element is provided, and the variation of the oscillation frequency of the oscillator caused when a coin passes through the sorting coil is detected. In each of these sorting means, when an inserted coin passes through the sorting coil, a sorting signal indicating whether it is a true coin and a false coin is outputted, and simultaneously a coin counting signal is provided.

In a machine of this type, unlike the mechanical type coin sorting machine, there are no obstructive components such as a cradle and a carrier arm for determining the diameter of a coin and, accordingly, the number of components can be reduced. However, since a coin inserted in the coin inlet can roll along the coin passage without being obstructed by anything, it is readily possible to move the coin back to the coin inlet. In other words, if a real coin tied with a string is inserted into the coin inlet out of mischief, the coin can be moved back to the coin inlet by pulling the string tied to the coin. In this case, the coin count value is undoubtedly incorrect.

In order to eliminate this trouble or drawback, a device for preventing an inserted coin from being moved back has been provided at the coin inlet. In this case, at least it is possible to prevent an inserted coin from being moved all the way back to the coin inlet; however, limited movement of the coin is still possible and a noticeable error is produced in the coin count value. If the inserted coin is reciprocated through the coin sorting section several times by operating the string tied to the coin, the error in the count value is increased as much.

SUMMARY OF THE INVENTION

Accordingly, an object of the invention is to provide a coin sorting machine in which the above-identified drawbacks accompanying a conventional coin sorting machine are eliminated, so that once a coin inserted thereinto has been counted, it is impossible to move the coin back through the counting section.

The foregoing object of the invention can be achieved by a method in which gate means for segregating a true coin from a false coin according to a sorting signal outputted by a sorting means is employed as a means for preventing a coin from being moved back to the coin inlet, and a coin detector is provided in the coin passageway of a true coin which has passed through the gate means, the detection signal of the coin detector being employed as a coin counting signal.

It is more advantageous if the coin detector is a detector for controlling the other gate means adapted to distribute true coins separately according to the denominations thereof, thereby reducing the number of components.

As for the above-described means for preventing a coin from being moved back to the coin inlet, instead of a gate means, a protrusion member may be provided in the coin passageway of the true coins in such a manner that it can be selectively protruded into and retracted from the coin passageway, and when a coin is detected by the coin detector downstream of the protrusion member, the protrusion member is caused to protrude into the coin passageway thereby to prevent the coin from being pulled back to the coin inlet once it has been counted.

DETAILED DESCRIPTION OF THE INVENTION

Figure 1:
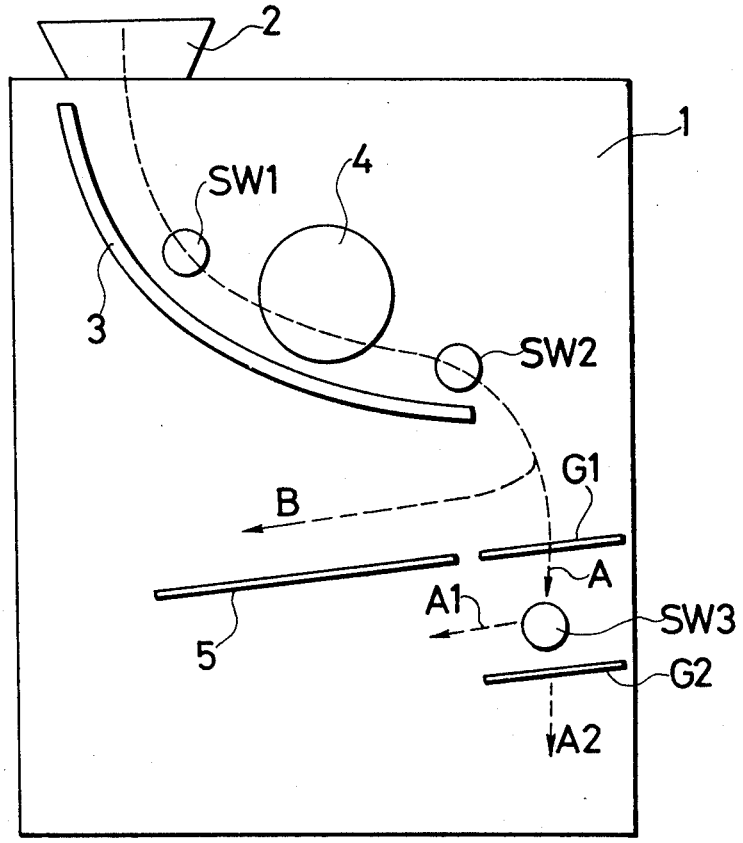
FIG. 1 is a front view showing essential components of a coin sorting machine to which the technical concept of the invention is applied.

Referring to FIG. 1, reference numeral 1 designates a coin sorting machine body; reference numeral 2, a coin inlet; reference numeral 3, a protruded piece forming a coin passageway; reference numeral 4, a sorting coil forming a part of a sorting means; reference numeral 5, a flanged coin passageway along which a false coin is moved; reference characters SW1 through SW3, detectors made up of light emission diodes or phototransistors; and reference characters G1 and G2, gates.

A coin inserted into the coin inlet 2 rolls along the protruded piece 3, and passes through the detector SW1, the sorting coil 4, and the detector SW2. If the coin is a false coin, the gate G1 is protruded into the coin passageway, as a result of which the false coin is forwarded in the direction of the arrow B and is returned through the false coin passageway 5. If the coin is a true coin, the gate G1 is retracted from the coin passageway, as a result of which the true coin is directed in the direction of the arrow A and passed through the detector SW3, whereupon the coin is forwarded in the direction of the arrow A1 or in the direction of the arrow A2 according to the denomination thereof by means of the gate G2.

Figure 2:
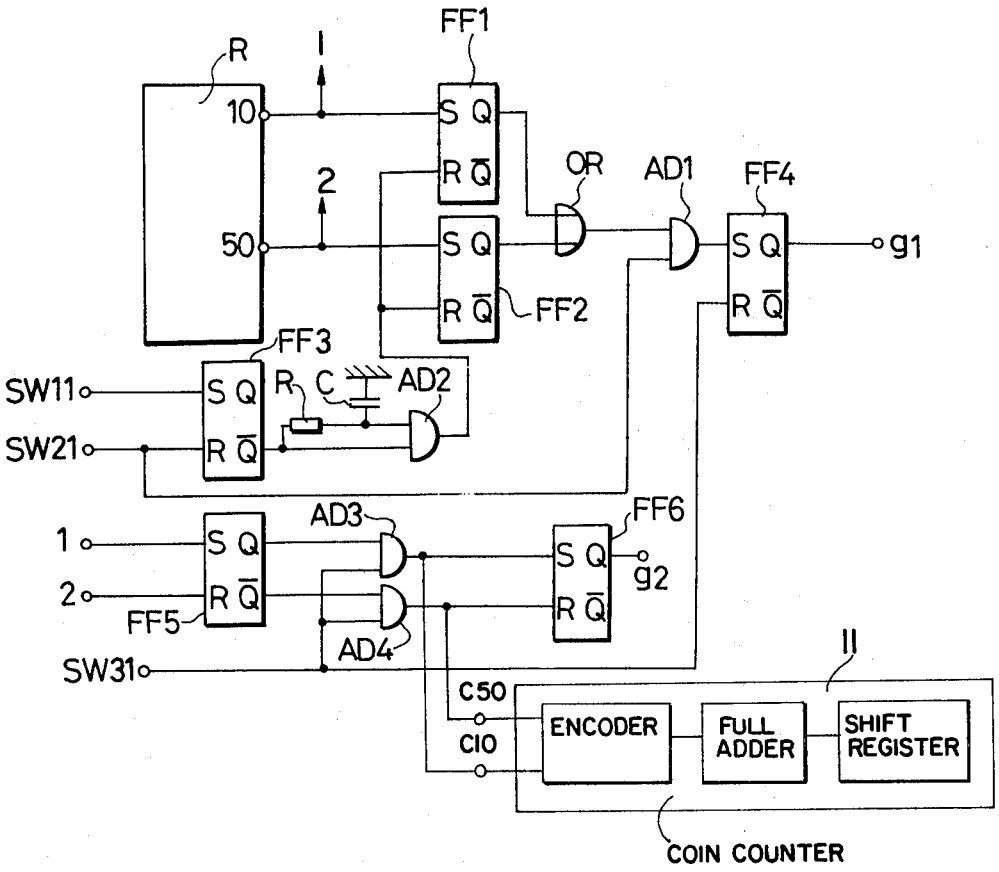
FIG. 2 is a block diagram showing a control circuit employed in the machine.

A control circuit for the embodiment of this invention is shown in FIG. 2. Referring to FIG. 2, reference character R is intended to designate a sorting section in which the sorting coil 4 is employed as a part of the sorting means, the sorting section R having the output terminal 10 of a first value coin sorting circuit and the output terminal 50 of a second value coin sorting circuit. According to sorting signals provided by the sorting section, a flip-flop FF1 stores that a first value coin has been inserted, and a flip-flop FF2 stores that a second value coin has been inserted. In this case, the coin sorting period during which the sorting section R determines if an inserted coin is a true coin or a false coin is determined by the operation of a flip-flop FF3. This will be described in more detail.

The flip-flop FF3 is connected to the output terminals SW11 and SW21 of the detectors SW1 and SW2. When no coin is inserted into the coin inlet, the flip-flop FF3 provides a logical signal "1" (hereinafter referred to merely as a signal "1", or "1", when applicable) at its terminal $\overline{Q}$, which is applied, as a reset signal, to the flip-flops FF1 and FF2 through an AND circuit AD2. When a coin is inserted and detected by the detector SW1, the flip-flop FF3 is set and the reset state of the flip-flops FF1 and FF2 is therefore released, as a result of which the coin sorting period is started. Thereafter, when the inserted coin passes through the sorting coil 4 and reaches the detector SW2, the flip-flop FF3 is reset and the flip-flops FF1 and FF2 are therefore reset through the AND circuit AD2, as a result of which the coin sorting period is ended. If the sorting signal (indicative of a true coin) is applied to the flip-flops FF1 or FF2 by the sorting section R during the coin sorting period which exists from the instant that a coin passes through the detector SW1 to release the reset states of the flip-flops FF1 and FF2 until the coin passes through the detector SW2 to apply the reset input signal to the flip-flops FF1 and FF2, then it is stored that the inserted coin is a true coin; i.e. either FF1 or FF2 is set, depending upon the value or denomination of the coin.

The memory state of the flip-flop FF1 or FF2 is applied through an OR circuit OR to one input terminal of an AND circuit AD1, to the other input terminal of which the detection signal of the detector SW2 is applied. Accordingly, the AND condition of the AND circuit AD1 is satisfied when the inserted coin reaches the detector SW2 under the condition that it has been stored in the flip-flop FF1 or FF2 that the inserted coin is a true coin. As a result, a flip-flop FF4 connected to the AND circuit AD1 is set to output a gate signal through a gate terminal g1, so that the gate G1 shown in FIG. 1 is retracted from the coin passageway. The flip-flop FF4 is reset by the detection signal of the detector SW3. A resistor R and a capacitor C connected between the terminal $\overline{Q}$ of the flip-flop FF3 and the AND circuit AD2 are to reset the flip-flops FF1 and FF2 with a predetermined short time delay to positively control the operation of the gate G1.

The control of the gate G2 shown in FIG. 1 is effected by a flip-flop FF5 connected to the terminals 10 and 50 of the sorting section R corresponding to first and second coin values, by an AND circuit AD3 which receives through its one terminal the output provided at the terminal Q of the flip-flop FF5 and receives through its other terminal the detection output SW31 of the detector SW3, by an AND circuit AD4 which receives through its one terminal the output provided at the terminal $\overline{Q}$ of the flip-flop FF5 and receives through its other input terminal the detection output of the detector SW3, and by a flip-flop FF6 which receives the outputs of the AND circuits AD3 and AD4. When upon application of the sorting signal through the terminal 10 from the sorting section R the flip-flop FF5 is set, and the coin is detected by the detector SW3, the AND condition of the AND circuit AD3 is satisfied, whereby the flip-flop FF6 is set. As a result, the gate signal is applied through the gate terminal g2 to the gate G2, so that the gate G2 is retracted from the coin passageway to forward the coin in the direction of the arrow A2. On the other hand, when the sorting signal is provided through the terminal 50 of the sorting section R to reset the flip-flop FF5 and the coin is detected by the detector SW3, the AND condition of the AND circuit AD4 is satisfied to reset the flip-flop FF6. In this case, a logical signal "0" (hereinafter referred to merely as a signal "0", or "0", when applicable) is provided at the gate terminal g2, so that the gate G2 is protruded into the coin passageway and the coin is therefore forwarded in the direction of the arrow A1. Thus, the gate G2 is controlled according to the sorting signal of the sorting section R and when the coin reaches the detector SW3, the detection signal of the detector SW3 is transmitted, as an inserted coin counting signal, through a terminal C10 or C50 to be counted by a conventional coin counter 11 consisting of, for example, an encoder, full adder and shift register. The first and second coin counting signals on the terminals C10 and C50 are applied to the encoder which encodes the signals to provide corresponding binary-coded signals which are then added in the full adder. The output of the full adder is applied to the shift register where the total amount of the inserted coins are represented in decimal fashion.

Figure 3:
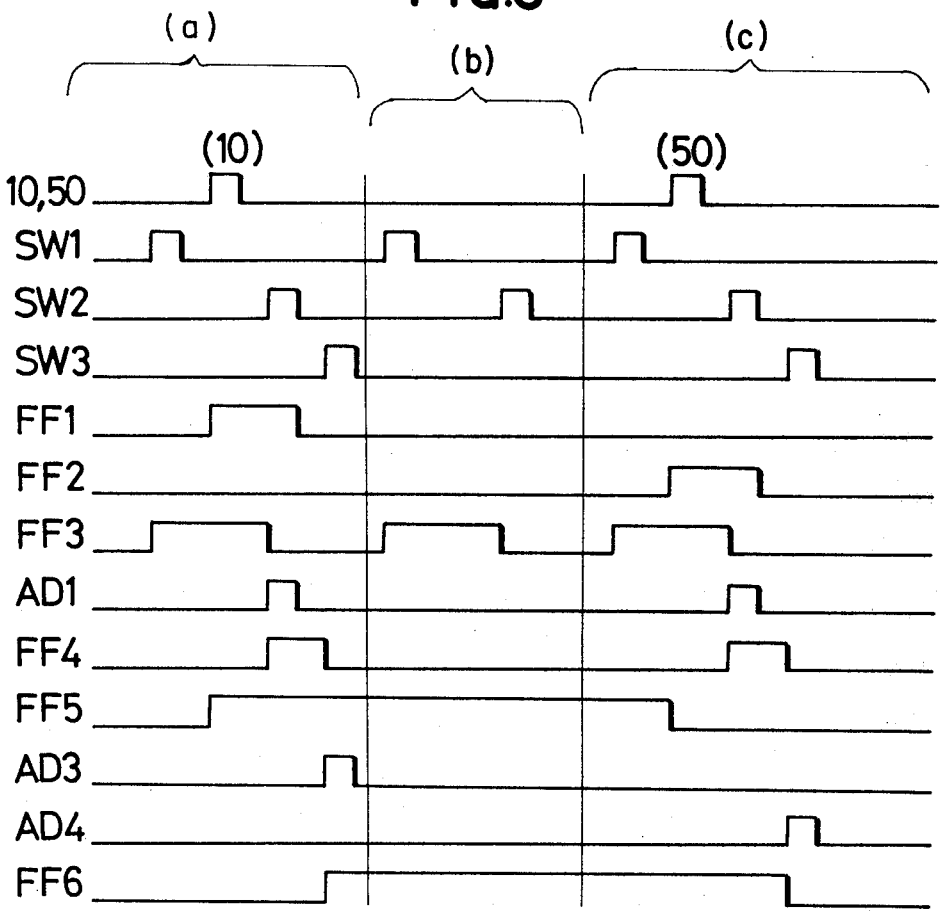
FIG. 3 shows various waveforms for a description of the control circuit shown in FIG. 2.

The operation of the coin sorting machine will be described with reference to waveforms indicated in FIG. 3, in which columns (a), (b) and (c) are for the case where a first value coin is inserted, the case where a false coin is inserted, and the case where a second value coin is inserted, respectively. When no coin is inserted into the coin inlet, the flip-flops FF1 through FF6 are in reset state.

When a first value coin is inserted into the coin inlet 2 (FIG. 1) it is first detected by the detector SW1. As indicated by SW1 in the column (a) of FIG. 3, the flip-flop FF3 is set by the detection signal "1" of the detector SW1, and the signal "0" is provided at its terminal $\overline{Q}$, as a result of which application of the reset input signal to the flip-flops FF1 and FF2 is released. When the coin passed through the detector SW1 reaches the sorting coil 4, it is sorted out, and the sorting signal "1" as indicated by 10 in the column (a) of FIG. 3 is applied through the terminal 10 of the sorting section R to the set terminals S of the flip-flops FF1 and FF5. When the flip-flop FF1 is set, it provides the signal "1" at its terminal Q, which is applied through the OR circuit OR to one input terminal of the AND circuit AD1. When the inserted coin, passing through the sorting coil 4, is detected by the detector SW2, the signal "1" is applied to the reset terminal R of the flip-flop FF3 and the other input terminal of the AND circuit AD1 through the terminal SW21. Simultaneously when the detector SW2 detects the coin, the AND condition of the AND circuit AD1 is satisfied, as a result of which the flip-flop FF4 is set, and the signal "1" is applied through its terminal Q to the gate terminal g1, so that the gate G1 is retracted from the coin passageway. Upon reception of the detection signal from the detector SW2, the flip-flop FF3 is reset; however, the AND condition of the AND circuit AD2 connected to its terminal $\overline{Q}$ is not satisfied immediately when the signal "1" is provided at the terminal $\overline{Q}$ of the flip-flop FF3; that is, the AND condition thereof is satisfied with a predetermined time delay attributed to the capacitor C, so as to apply the reset signal to the flip-flops FF1 and FF2 to reset the latter.

The coin forwarded in the direction of the arrow A without being blocked by the gate G1 after passing through the detector SW2 is detected by the detector SW3. The detection signal of the detector SW3 is applied, as a reset signal, to the flip-flop FF4 and is applied also to one input terminal of the AND circuit AD3 to the other input terminal of which the output of the flip-flop FF5 is applied through its terminal Q. When the flip-flop FF4 is reset, the signal "0" is provided at its terminal Q, as a result of which the gate G1 is protruded into the coin passageway. The AND condition of the AND circuit AD3 is satisfied with the detection signal of the detector SW3 because the flip-flop FF5 has been set, whereby the flip-flop FF6 is set. As a result, the signal "1" is provided at the terminal Q of the flip-flop FF6, and is applied to the gate terminal g2, so that the gate G2 is retracted from the coin passageway. Accordingly, the coin is allowed to drop in the direction of the arrow A2 without being blocked by the gate G2. The output of the AND circuit AD3 is transmitted, as a coin counting signal, through the terminal C10. Thus, the first value coin sorting operation has been achieved.

Now, the case where an inserted coin is a false coin, will be described. The waveform in this case are indicated in the column (b) of FIG. 3.

When the coin is detected by the detector SW1, the flip-flop FF3 is set, and therefore the reset states of the flip-flops FF1 and FF2 are released. The inserted coin reaches the sorting coil 4 after passing through the detector SW1; however, no sorting signal is provided by the sorting section R because it is a false coin. Thereafter, the coin reaches the detector SW2; however, the AND condition of the AND circuit AD1 is not satisfied, because the flip-flops FF1 and FF2 are still in reset state. Accordingly, the flip-flop FF4 is maintained reset. Therefore, the gate G1 protruded into the coin passageway is maintained as it is, and therefore the coin is not allowed to drop because it is blocked by the gate G1, that is, the coin is forwarded in the direction of the arrow B so as to be returned. The detection signal of the detector SW2 resets the flip-flop FF3, whereby the reset input signal is applied to the flip-flops FF1 and FF2. Thus, the machine is placed in standby state to be ready for the next coin. In this case, the states of the flip-flops FF5 and FF6 are not changed from their states obtained in the previous coin sorting operation, because no coin is passed through the detector SW3.

Now, the case where a second value coin is inserted into the coin inlet, will be described. The waveforms in this case are as indicated in the column (c) of FIG. 3.

When the coin is detected by the detector SW1, the flip-flop FF3 is set and, therefore, the reset states of the flip-flops FF1 and FF2 are released, similarly as in the above-described case. When the coin reaches the sorting coil 4, the sorting signal is provided through the terminal 50 of the sorting section R. The sorting signal is applied, as a set input signal, to the flip-flop FF2 and, as a reset input signal, to the flip-flop FF5. When the flip-flop FF2 is set, the signal "1" is applied through the OR circuit OR to one input terminal of the AND circuit AD1. When the flip-flop FF5 is reset, the signal "1" is provided at its terminal $\overline{Q}$ and is applied to one input terminal of the AND circuit AD4. When the coin, passing through the sorting coil 4, reaches the detector SW2, the detection signal of the detector SW2 is applied through the terminal SW21 to the other input terminal of the AND circuit AD1. Thus, the AND condition of the AND circuit AD1 is satisfied, and therefore the flip-flop FF4 is set. As a result, the gate G1 is retracted from the coin passageway so that the coin is dropped forwarded in the direction of the arrow A without being blocked by the gate G1. Similarly as in the above-described case, the flip-flop FF3 is reset by the detection signal of the detector SW2, and the reset signal is applied to the flip-flops FF1 and FF2.

The coin, passing through the detector SW2 and the gate G1, is forwarded in the direction of the arrow A as was described above. Thereafter, the coin is detected by the detector SW3. Accordingly, the detection signal of the detector SW3 is applied through the terminal SW31 to the reset input terminal R of the flip-flop FF4 and to one input terminal of the AND circuit AD4. When the flip-flop FF4 is reset by the detection signal of the detector SW3, the gate G1 is protruded into the coin passageway, so that the machine becomes ready for the next coin. Upon application of the detection signal of the detector SW3 to the AND circuit AD4, the AND condition thereof is satisfied because the flip-flop FF5 has been reset by the sorting signal, and therefore the coin counting signal is provided through the terminal C50 by the AND circuit AD4, while the flip-flop FF6 is reset. When the flip-flop FF6 is reset, the gate G2 which has been retracted from the coin passageway is protruded into the coin passageway. As a result, the gate G2 prevents the dropping of the coin, that is, it is forwarded in the direction of the arrow A1.

In the embodiment described above, coins of the two denominations are handled; however, it is obvious that the technical concept of the invention can be applied to the case where coins of more than two denominations are sorted out. If coins of only one denomination are handled, the gate G2, the flip-flops FF5 and FF6, and the AND circuits AD3 and AD4 are unnecessary, and the output of the detector SW3 can be employed as the coin counting signal.

As is apparent from the above description, according to the invention, a true coin passed through the gate adapted to segregate a false coin from a true coin is detected to provide the coin counting signal. Therefore, the drawbacks accompanying the conventional coin sorting machine that if a coin tied with a string is reciprocated in the coin passageway out of mischief the result of the coin counting operation becomes erroneous, or after the coin counting signal has been outputted the coin is pulled back, can be eliminated. A further advantage is that the detector SW3 for outputting the coin counting signal is used commonly as the detector for controlling the gate G2 adapted to distribute coins separately according to the denominations and, thus, the number of necessary components is reduced.

What is claimed is:

1. In a coin sorting and counting apparatus of the type including: coin sorting means for producing first and second coin sorting signals representing first and second true coin values, respectively, and for producing no coin sorting signal for a false coin; first coin detecting means located upstream of said coil sorting means for producing a first coin detection signal upon the passage of a coin; second coin detecting means located downstream of said coin sorting means for producing a second coin detection signal upon passage of a coin; first gate means located downstream of said second detecting means and responsive to the simultaneous occurrence of a true coin sorting signal and said second coin detection signal to direct a coin along a true coin path; the improvement comprising:

first and second flip-flop means for respectively storing first and second coin sorting signals which occur in the interval between the occurrences of said first and second coin detection signal;

third flip-flop means settable in a first state in response to the simultaneous occurrence of said second coin detection signal and a stored coin sorting signal in either of said first and second flip-flop means for producing a first gate control signal to open said first gate means to direct a coin along said true coin path;

third coin detection means located in said true coin path for producing a third coin detection signal upon the passage of a coin;

fourth flip-flop means having set and reset inputs and set and reset outputs;

means supplying said first and second coin sorting signals to said set and reset inputs, respectively;

first AND circuit means having two inputs coupled to said set output and to said third detection signal, respectively, for producing a first coin counting signal upon each simultaneous occurrence of a first coin sorting signal and a third coin detection signal;

second AND circuit means having two inputs coupled to said reset output and to said third detection signal, respectively, for producing a second coin counting signal upon each simultaneous occurrence of a second coin sorting signal and a third coin detection signal;

coin counting means for respectively counting the number of said first and second coin counting signals; and means for applying said third coin detection signal to said third flip-flop means to reset it to a second state thereby removing said first gate control signal and closing said first gate means so that a counted coin cannot be withdrawn from said true coin path.

2. The improvement as claimed in claim 1 further comprising:

second gate means for selectively directing counted coins along first and second paths, respectively, in accordance with their denominations;

fifth flip-flop means having set and reset inputs coupled to said first and second counting signals, respectively, and producing a second gate control signal in response to only one of said counting signals; and means for supplying said second gate signal to said second gate means to cause it to direct a counted coin along one of said first and second paths.

* * * * *